US006345612B1

(12) United States Patent
Gärtner

(10) Patent No.: US 6,345,612 B1
(45) Date of Patent: Feb. 12, 2002

(54) EXHAUST GAS RECIRCULATION ARRANGEMENT INCLUDING A DISC VALVE

(75) Inventor: Uwe Gärtner, Remshalden (DE)

(73) Assignee: DaimlerChrysler AG, Stuttgart (DE)

( * ) Notice: Subject to any disclaimer, the term of this patent is extended or adjusted under 35 U.S.C. 154(b) by 31 days.

(21) Appl. No.: 09/592,540

(22) Filed: Jun. 12, 2000

(30) Foreign Application Priority Data

Jun. 15, 1999 (DE) ..... 199 27 186

(51) Int. Cl.[7] ..... F02M 25/07

(52) U.S. Cl. ..... 123/568.11; 123/568.21; 123/568.26

(58) Field of Search ..... 123/568.11, 568.17, 123/568.18, 568.19, 568.21, 568.26, 568.27, 568.29

(56) References Cited

U.S. PATENT DOCUMENTS

| | | | | |
|---|---|---|---|---|
| 3,762,384 A | | 10/1973 | Day et al. | 123/568.29 |
| 3,774,583 A | | 11/1973 | King | 123/568.29 |
| 3,921,611 A | * | 11/1975 | Walker | 123/568.29 |
| B 480,384 | | 3/1976 | Hashiguchi et al. | 123/568.29 |
| 3,972,312 A | * | 8/1976 | Walker | 123/568.29 |
| 4,056,083 A | * | 11/1977 | Wakita | 123/568.27 |
| 4,350,136 A | * | 9/1982 | Yanagisawa | 123/568.29 |
| 6,164,269 A | * | 12/2000 | Feucht et al. | 123/568.11 |

FOREIGN PATENT DOCUMENTS

| | | |
|---|---|---|
| DE | 196 07 811 | 9/1997 |
| DE | 198 25 583.7 | 12/1999 |
| DE | 199 20 820 | 11/2000 |
| JP | 11-270414 | 10/1999 |

* cited by examiner

*Primary Examiner*—Willis R. Wolfe
(74) *Attorney, Agent, or Firm*—Klaus J. Bach

(57) ABSTRACT

In an exhaust gas recirculation arrangement comprising a housing forming a passage for an exhaust gas flow of an internal combustion engine and having a valve seat with a valve disc movably supported in the housing on a valve stem so as to be seated on the valve seat for closing the valve but being movable therefrom against the flow direction of the exhaust gas for opening the valve, a flow guide member is disposed in the valve housing upstream of the valve disc in such a way that, in its open position, the valve disc abuts the guide member and the guide member conducts the exhaust gas past the valve disc.

12 Claims, 3 Drawing Sheets

EXHAUST GAS RECIRCULATION ARRANGEMENT INCLUDING A DISC VALVE

BACKGROUND OF THE INVENTION

The invention resides in an exhaust gas recirculation arrangement including a disc valve having a shaft which extends in the flow direction of the exhaust gas and which opens essentially in a direction opposite the flow direction of the exhaust gas through the valve.

In order to improve the combustion of internal combustion engines and also the quality of the exhaust gases, part of the exhaust gas may be recirculated from the exhaust gas passage back to the engine intake passage. For an effective exhaust gas recirculation, it is important that the recirculated exhaust gas is uniformly mixed with the fresh intake air and that the recirculated exhaust gas volume does not change unintentionally over the operating period or over the lifetime of the internal combustion engine, but that the exhaust gas is admixed to the intake air depending on certain selected control parameters. Furthermore, the hot exhaust gases should not thermally overstress the control mechanism of the exhaust gas recirculation arrangement. The control mechanisms generally include disc valves, which are operated pneumatically, electromagnetically or in a similar way.

In internal combustion engines for commercial vehicles, disc valves for the control of the exhaust gas recirculation are generally operated by compressed air. Furthermore, in vehicles with motor brakes, very high pressures can develop in the exhaust system during braking operation. If the disc valve opens in the flow direction of the recirculated exhaust gas, the exhaust gas pressures generated during braking operation may exceed the closing force of the disc valve so that the valve opens. As a result, the back pressure in the exhaust system drops which causes a substantial loss in braking power and which must be avoided under any circumstances for safety reasons. This disadvantage is avoided if the disc valve opens against the flow direction of the exhaust gas since then the exhaust gas pressure presses the valve disc against the valve seat when the valve is closed. However, the arrangement has the disadvantage that, in an open position, the valve disc is disposed in the flow of the exhaust gas so as to act as a baffle plate. It generates a high flow resistance if the valve shaft extends in a downstream direction from the valve seat.

In addition, valves which open against the flow direction of the exhaust gas require generally more space in order to provide around the open disc of the valve a sufficiently large flow cross-section for the exhaust gas. Furthermore, the disc valve, when fully opened, is fully exposed to the exhaust gas flow so that it may be caused to vibrate as a result of pressure pulsations in the exhaust gas flow. In this case, the flow cross-section is constantly changed and the recirculated exhaust gas volume varies accordingly and no longer provides for the desired exhaust gas recirculation volume.

DE 195 24 603 C1 discloses an internal combustion engine with an exhaust gas recirculation arrangement of this type. The valve disc is pressed against the valve seat by a closing spring and is opened by pressurized air by way of a membrane operator. It is also possible to bias the valve by spring forces towards an open position and close the valve by compressed air.

DE 196 07 811 A1 also discloses such an exhaust gas recirculation arrangement. In this case, the disc valve is operated by an electromagnet. For overcoming the exhaust gas forces effective on the valve in a closing direction, the valve shaft includes a compensation passage, which provides for communication between the exhaust gas passage and a compensation chamber in the operating element.

Furthermore, DE 43 34 370 C1 discloses an exhaust gas valve in the form of a disc valve which opens against the flow direction of the exhaust gas and against the forces of a closing spring. The valve shaft extends from the valve disc in an upstream direction and is protected from the exhaust gas flow by a metal bellows with its end surfaces abutting at one end the valve disc and at the other end the valve housing.

Finally, DE 197 25 668 A1 discloses an exhaust gas recirculation arrangement with a disc valve whose valve disc opens against the flow direction of the exhaust gas. The valve disc has a somewhat streamlined shape, that is, it is for example cone-shaped, or semi-spherical. With such a shape of the valve disc, the influence of the exhaust gas flow is reduced but, at the same time, the mass of the valve disc is increased, which is disadvantageous for the acceleration and deceleration behavior of the disc valve, and which requires a stronger valve operating mechanism. Since, furthermore, the surface areas of the valve disc in contact with the exhaust gas flow and also the valve mass are increased, more heat is conducted into the valve disc and the valve operating mechanism.

It is the object of the present invention to provide an exhaust gas recirculation arrangement with a disc valve which has a low mass and which is protected from pressure pulsations when open.

SUMMARY OF THE INVENTION

In an exhaust gas recirculation arrangement comprising a housing forming a passage for an exhaust gas flow of an internal combustion engine and having a valve seat with a disc valve movably supported in the housing on a valve stem so as to be seated on the valve seat for closing the valve but being movable therefrom for opening the valve against the flow direction of the exhaust gas, a flow guide member is disposed in the valve housing upstream of the valve disc in such a way that, in its open position, the valve disc abuts the guide member and the guide member conducts the exhaust gas past the valve disc.

In this way, the exhaust gas flow has relatively low losses and the valve disc is not affected by pressure pulsations in the exhaust gas flow. When the valve is open the guide structure provides for some protection of the valve body from the exhaust gas flow so that the heat transfer to the disc valve is relatively low. When the valve is closed, the heat transfer to the valve disc is low anyway because there is no gas movement past the valve disc and the valve disc is exposed to the hot exhaust gas only with a small surface area at the front end thereof.

With the arrangement according to the invention, the valve disc may be flat so that it has only a small mass and can be operated by a relatively small operating mechanism. At its upstream end, the guide structure has a streamlined outer shape that is it may be cone-shaped or semi-spherical. Radially extending webs support the guide structure in the exhaust gas passage of the valve housing. It is advantageous if also the webs are streamlined and have a low flow resistance. They may, for example, be drop-shaped in the flow direction with a ratio of their length in flow direction to their maximum thickness of about 5.

In order to ensure a well-defined opening position of the valve disc, it is advantageous if the guide structure includes at the downstream end face thereof a stop surface for the valve disc which is abutted by the valve disc when it is in a fully open position. In order to ensure that the smallest possible amount of heat is transferred from the guide structure to the valve disc, the guide structure includes at its downstream end, a recess adjacent to which the stop surface is disposed in the form of a narrow annular area. In order to reduce further the size of the stop area, it may be interrupted circumferentially several times.

In another embodiment, the guide structure includes a rim, which surrounds, and extends beyond, most of the valve disc in the flow direction. The recessed area of the guide structure formed by the rim protects the valve disc from the exhaust gas flow when it is in its open position.

In order to provide a sufficiently large flow cross-section for the exhaust gas flow in the area of the flow guide structure, it is advantageous if the exhaust gas passage is widened in this area to form a double-conical valve chamber. For manufacturing reasons, the valve housing is divided transversely in the area of the largest diameter of the double-conical valve housing.

Further advantages will become apparent from the following description of the invention on the basis of the accompanying drawings. The drawings show various embodiments of the invention. The description and claims refer to numerous features, which may be taken by an expert individually and combined to form additional embodiments of the invention.

DESCRIPTION OF PREFERRED EMBODIMENTS

Figure 1:
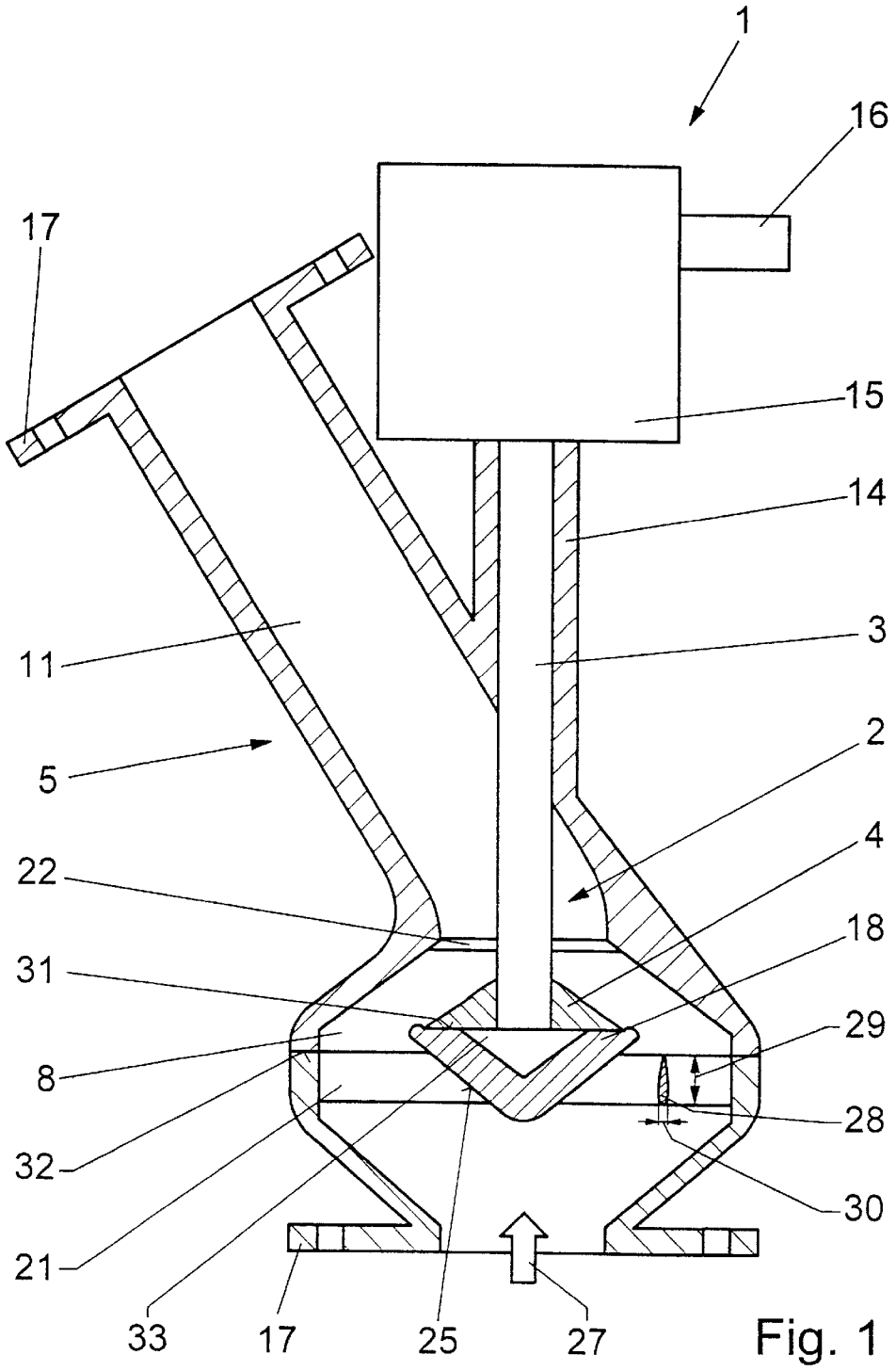
FIG. 1 is a schematic representation of an exhaust gas recirculation arrangement with a guide structure having a cone-shaped outer contour.
Figure 2:
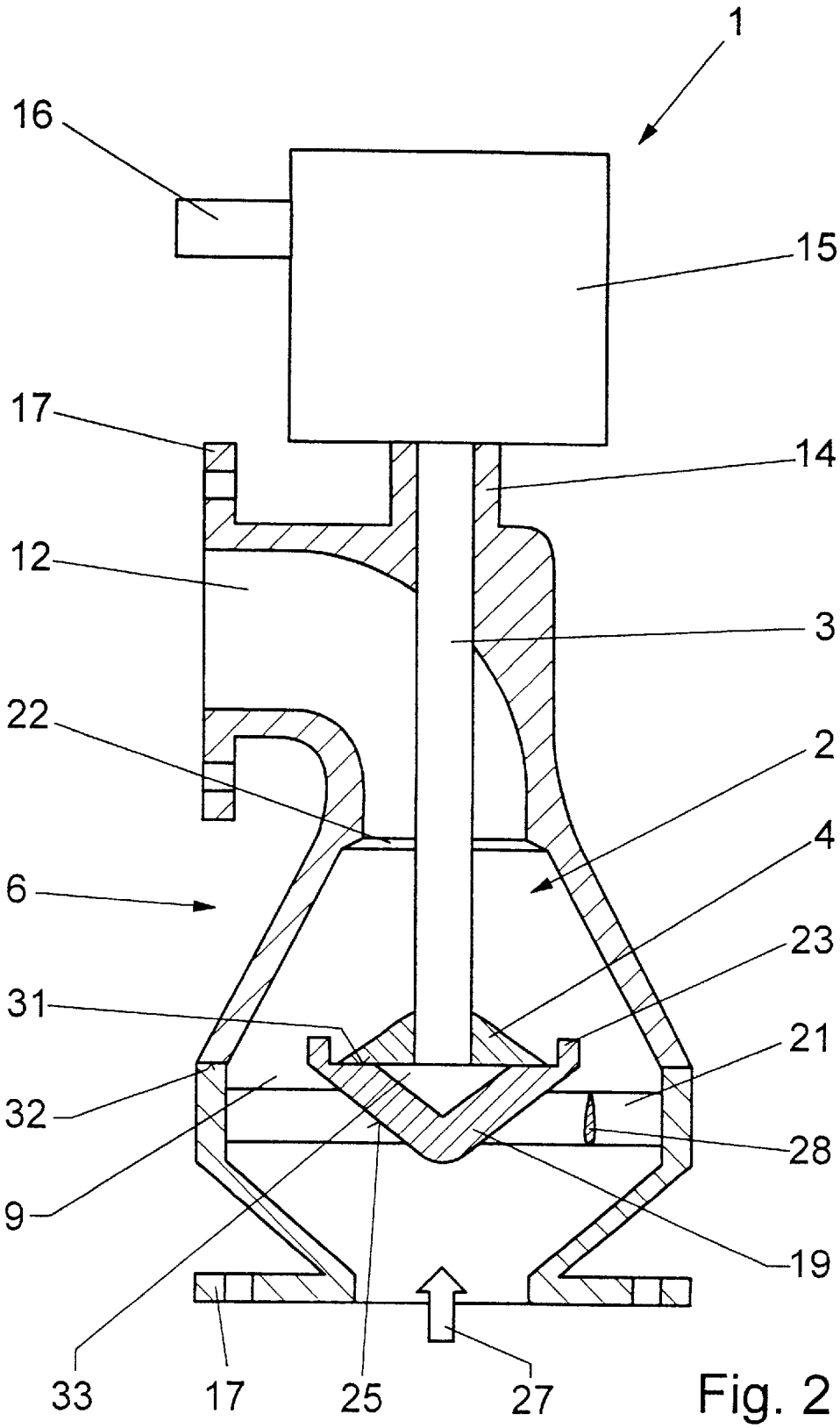
FIG. 2 shows another embodiment of the arrangement shown in FIG. 1
Figure 3:
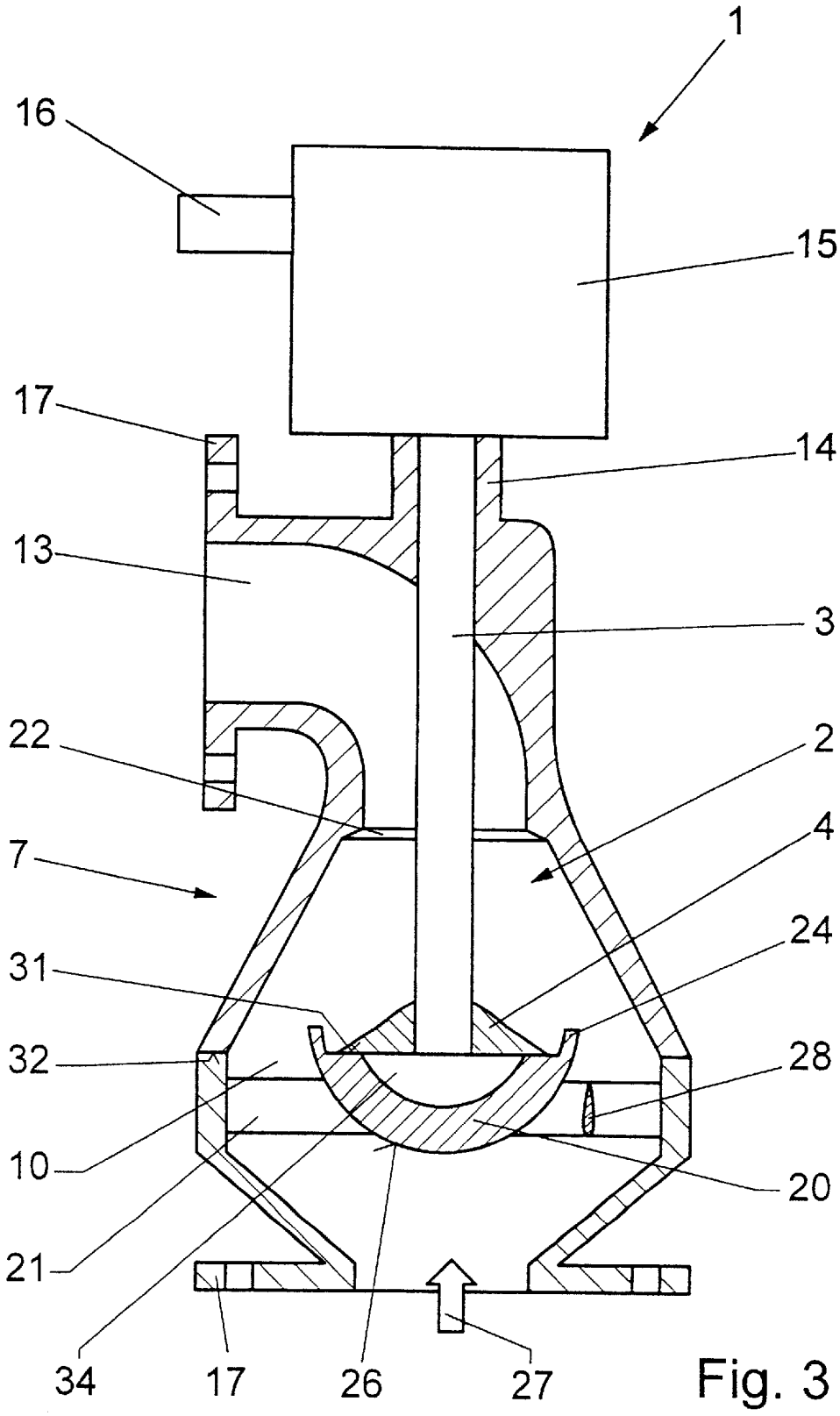
FIG. 3 shows still another embodiment of the arrangement shown in FIG. 1.

An exhaust gas recirculation arrangement 1 comprises a disc valve 2 with a valve shaft 3 and a valve disc 4. The valve disc 4 is guided in a valve guide structure 14 of the valve housing 5, 6, 7 and is operated by an operating device 15, which includes a control connection 16 that is, a compressed air connection or an electric power supply. The valve housing 5, 6, 7 includes in the various embodiments as shown in FIG. 1, FIG. 2 and FIG. 3 an exhaust gas passage 11, 12, 13, which is enlarged in the area of the valve disc 4 to form a double conical valve chamber 8, 9, 10. For manufacturing reasons the chamber 8, 9, 10 is divided along a transverse plane 32. The valve chamber 8, 9, 10 includes, downstream of the valve disc 4, a valve seat 22 on which the valve disc 4 is disposed when the disc valve 2 is closed. The arrow 27 indicates the flow direction of the exhaust gas.

Upstream of the valve seat 22, the valve chamber 8, 9, 10 includes a guide member 18, 19, 20, which is supported in the valve housing 5, 6, 7 by at least one web 21. The web 21 has a streamlined profile 28 which is drop-shaped in the flow direction 27 and which has a length 29 in flow direction 27, which is about 5 times its maximum width 30. The guide member 18, 19 (FIG. 1, FIG. 2) has at its front end a streamlined outer shape 25 in the form of a cone whereas the guide member 20 (FIG. 3) has a corresponding semi-spherical outer shape 26. The valve housing 5, 6, 7 is provided, at the opposite ends of the exhaust gas passage 11, 12, 13 with flanges 17 by way of which it may be connected to an exhaust gas system (not shown) of an internal combustion engine.

The guide body 18, 19 20 includes a recess 34 or, respectively, 33 at the downstream side. Around the recess 33, 34, an annular support surface 31 is disposed. Radially inwardly, the annular support surface 31 is limited by the recess 33, 34. The annular support surface 31 consequently has a relatively small surface area so that only relatively little heat is conducted to the valve disc 4 by way of the support surface 31. The contact area of the support surface 31 can be further reduced by several interruptions arranged on said annular support surface in circumferentially spaced relationship.

The guide body 18, 19, 20 extends radially beyond the valve disc 4 and consequently protects the valve disc 4 from hot exhaust gases. In addition, pressure pulsations in the exhaust gas flow have no influence on the opening position of the disc valve 2. In the embodiments shown for the guide body 19, 20, a rim 23, 24 surrounds the valve disc 4 when the valve disc 4 is in its open position (FIG. 2, FIG. 3). With this arrangement, the valve disc 4 is particularly well protected from the hot exhaust gases.

What is claimed is:

1. An exhaust gas recirculation arrangement comprising a housing forming a passage for an exhaust gas flow of an internal combustion engine, a valve seat formed in said housing, a disc valve movably supported in said housing on a valve stem and having a valve closing position in which said valve disc is disposed on said valve seat and being movable therefrom against the flow direction of the exhaust gas flow through said valve for opening said valve, and a flow guide member disposed in said valve housing upstream of said valve disc in such a way that, in its open position, said valve disc abuts said guide member whereby the exhaust gas is conducted by said guide structure past said valve disc.

2. An exhaust gas recirculation arrangement according to claim 1, wherein said guide body has a cone-like outer contour.

3. An exhaust gas recirculation arrangement according to claim 1, wherein said guide body has a semi-spherical outer contour.

4. An exhaust gas recirculation arrangement according to claim 1, wherein said guide body has a rim within which said valve disc is received when it abuts said seating surface of said guide body in the open position of said valve.

5. An exhaust gas recirculation arrangement according to claim 1, wherein said exhaust gas passage through said valve body is widened in the area of said guide body so as to form an essentially double-conical valve chamber.

6. An exhaust gas recirculation arrangement according to claim 5, wherein said valve housing is divided transversely in the area of the largest diameter of the double-conical valve chamber.

7. An exhaust gas recirculation arrangement according to claim 1, wherein said guide body is supported in said exhaust gas passage by radial webs.

8. An exhaust gas recirculation arrangement according to claim 7, wherein said webs are streamlined in the flow direction of said exhaust gas through said valve.

9. An exhaust gas recirculation arrangement according to claim 7, wherein said streamlined web profile is drop-shaped wherein the length of said webs in flow direction of said exhaust gas is about five times their maximum width.

10. An exhaust gas recirculation arrangement according to claim 1, wherein said guide member includes at its upstream side a seating surface area for said valve disc.

11. An exhaust gas recirculation arrangement according to claim 10, wherein said guide body has at its downstream end face a recess and said seating surface area is an annular area extending around said recess.

12. An exhaust gas recirculation arrangement according to claim 11, wherein said annular seating surface area is interrupted at spaced circumferential locations.

* * * * *